US010784032B2

(12) United States Patent
Sümegi

(10) Patent No.: US 10,784,032 B2
(45) Date of Patent: Sep. 22, 2020

(54) BISTABLE ELECTROMECHANICAL ACTUATOR

(71) Applicant: István Andor Sümegi, Dunakeszi (HU)

(72) Inventor: István Andor Sümegi, Dunakeszi (HU)

( * ) Notice: Subject to any disclaimer, the term of this patent is extended or adjusted under 35 U.S.C. 154(b) by 243 days.

(21) Appl. No.: 16/080,415

(22) PCT Filed: Dec. 16, 2016

(86) PCT No.: PCT/HU2016/050065

§ 371 (c)(1),
(2) Date: Aug. 28, 2018

(87) PCT Pub. No.: WO2017/109523

PCT Pub. Date: Jun. 29, 2017

(65) Prior Publication Data

US 2019/0080831 A1 Mar. 14, 2019

(30) Foreign Application Priority Data

Dec. 21, 2015 (HU) ..... 1500646

(51) Int. Cl.
*H01F 7/122* (2006.01)
*H01F 7/124* (2006.01)
(Continued)

(52) U.S. Cl.
CPC ..... *H01F 7/122* (2013.01); *H01F 7/0205* (2013.01); *H01F 7/081* (2013.01); *H01F 7/124* (2013.01); *H01F 7/1646* (2013.01)

(58) Field of Classification Search
CPC ..... H01F 7/0205; H01F 7/124
(Continued)

(56) References Cited

U.S. PATENT DOCUMENTS 813,638 A * 2/1906 Fretts ..... A63H 19/32 246/231
2,090,522 A * 8/1937 Sippel ..... H01H 51/088 361/192

(Continued)

FOREIGN PATENT DOCUMENTS

WO 2004/072418 A1 8/2004
WO 2014/168236 A1 10/2014

*Primary Examiner* — Alexander Talpalatski
(74) *Attorney, Agent, or Firm* — Jason D. Voight

(57) ABSTRACT

The bistable electromechanical actuator comprises an actuator shaft (7) arranged in a house (1), said shaft being movable along its longitudinal direction, a base member (11) attached to the actuator shaft (7), said base member being slidably attached to a guiding element (3, 3',3") through a stud (15), said guiding element being secured to the house and having two locking notches (2*a*, 2*b*) with a predetermined distance therebetween and further having a straight or substantially straight guiding section (2*c*) formed between said two locking notches in a plane parallel to the longitudinal direction of said shaft (7), wherein at least one permanent magnet is fixed to the base member (11) so that the magnetic axis of each permanent magnet is perpendicular or substantially perpendicular to the longitudinal direction of said shaft (7), and wherein at least one electromagnetic coil (13) is arranged within said house (1) so that in an idle state of the actuator, one end of each coil (13) is arranged to be adjacent to one of the at least one permanent magnet (12) in such a manner that the position of said end of the respective coil (13) is slightly offset, along the longitudinal direction of said shaft (7), with respect to the position of the permanent magnet (12) adjacent thereto.

10 Claims, 11 Drawing Sheets

(51) Int. Cl.
*H01F 7/16* (2006.01)
*H01F 7/02* (2006.01)
*H01F 7/08* (2006.01)

(58) Field of Classification Search
USPC ..... 335/229, 234
See application file for complete search history.

(56) References Cited

U.S. PATENT DOCUMENTS 2,526,685 A * 10/1950 Price ..... H01H 51/2281
335/234
3,432,784 A * 3/1969 Kim ..... H04L 17/18
335/254
4,771,255 A * 9/1988 Shull ..... H01F 7/124
335/169
4,814,732 A * 3/1989 Pratt ..... H01F 7/1646
335/230
2008/0169890 A1 7/2008 Irwin
2013/0102163 A1 4/2013 Basavarajappa et al.
2017/0016250 A1 1/2017 Sümegi et al.

* cited by examiner

BISTABLE ELECTROMECHANICAL ACTUATOR

This is the national stage of International Application PCT/HU2016/050065, filed Dec. 16, 2016.

The present invention relates to a bistable electromechanical actuator.

In the prior art various solutions are known for the bistable electromagnetic actuators. Such a solution is disclosed in the document WO 2015/140585, wherein under voltage the electromagnetic coils force the permanent magnets arranged on a crank shaft to turn by 180°. A lock pin is connected to the crank shaft for performing the locking action. As a result of voltage with an opposite polarity applied to the coils the process goes on in a reverse direction. In one of its positions the lock pin locks the transversal shaft, whereas in its other position the lock pin does not lock it. Thereby two stable end positions are provided. A drawback of this solution is that due to the rotation of the crank shaft by 180°, the lock pin also displaces in the lateral direction, which restricts the applicability of the actuator. The locking path of the lock pin is relatively short due to the structural design, therefore this device is less suitable for operating locks, locking assemblies, mechanical units or for using it as an actuator.

Other solutions are also known wherein the locking action in the two stable end positions is provided without the application of holding voltage, by means of an electric motor and various screw drive transmissions. These solutions include, for example, the actuators operating the central locks of vehicles. A similar solution is disclosed in the document WO 2011/120719, in which the two stable end positions, the displacement and the locking action are all provided without the application of holding voltage, by means of a screw drive transmission and a driving electric motor. A drawback of this solution is that it has a complicated structural design, which results in a higher chance of fault and also in a more expensive production.

The electrically driven actuators with a screw drive have the disadvantage that because of their complicated structural design they have a higher chance of fault and they have higher production costs.

It is an object of the present invention to provide a bistable electromechanical actuator which has a substantially long and powerful, straight-line working path and which provides two stable, mechanically locked end positions even without the application of holding voltage, thus it can be used instead of the conventional actuators that are driven by an electric motor and include a screw drive transmission. It is a further object to provide an actuator with a rather simple operational principle and a relatively simple design while being efficient, thereby allowing an easy projection of industrial applications, an optimal and stable operation, as well as high reliability and cost effective production.

The above objects are achieved by providing a bistable electromechanical actuator which comprises an actuator shaft arranged in a housing, said shaft being movable along its longitudinal direction, a base member attached to the actuator shaft, said base member being slidably attached to a guiding element through a stud, said guiding element being secured to the housing and having two locking notches with a predetermined distance therebetween and further having a straight or substantially straight guiding section formed between said two locking notches in a plane parallel to the longitudinal direction of said shaft, wherein at least two permanent magnets are fixed to the base member so that the magnetic axis of each permanent magnet is perpendicular or substantially perpendicular to the longitudinal direction of said shaft, and wherein at least one electromagnetic coil is arranged within said housing so that in an idle state of the actuator, one end of each coil is arranged to be adjacent to one of the at least one permanent magnet in such a manner that the position of said end of the respective coil is slightly offset, along the longitudinal direction of said shaft, with respect to the position of the permanent magnet adjacent thereto.

The above objects are further achieved by a bistable electromechanical actuator which comprises an actuator shaft arranged in a housing, said shaft being movable along its longitudinal direction, wherein said shaft has an actuator pin outside the housing, base member hingedly attached to the actuator shaft, said base member being slidably attached to a guiding element through two studs, said guiding element being secured to the housing and having two locking notches with a predetermined distance therebetween and further having a straight or substantially straight guiding section formed between said two locking notches in a plane parallel to the longitudinal direction of said shaft, wherein two permanent magnets are fixed to the base member, close to said studs, so that the magnetic axes of the permanent magnets define an acute angle, wherein at least one electromagnetic coil is arranged within said housing so that in an idle state of the actuator, one end of each coil is arranged to be adjacent to one of the two permanent magnets in such a manner that the position of said end of the respective coil is slightly offset, along the longitudinal direction of said shaft, with respect to the position of the permanent magnet adjacent thereto, and wherein the centers of rotation of the two studs and the center of rotation of the hinge of the base member do not reside on a single straight line.

The bistable electromechanical actuator according to the present invention will now be described in detail with reference to the drawings.

Similar elements in the figures are always referred to by the same reference numbers in the drawings.

Figure 2:
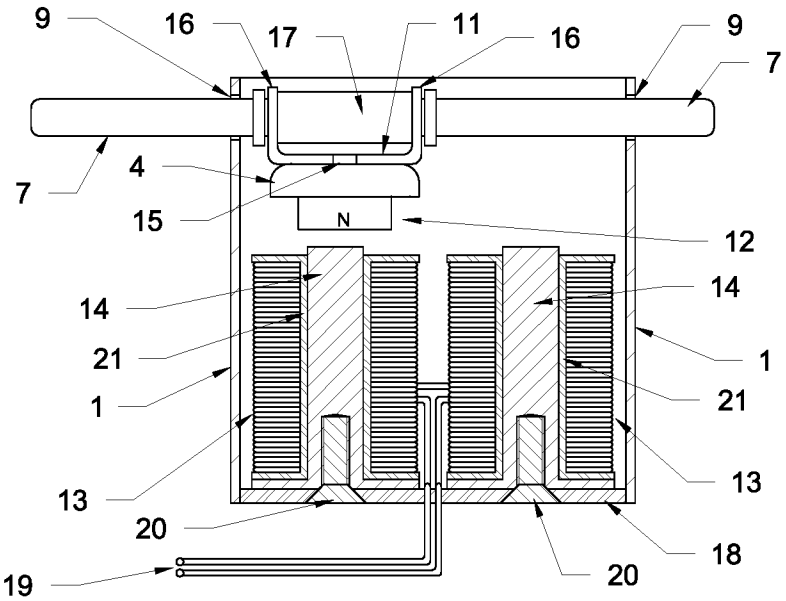
FIG. 2 is a partly sectional front view of the first embodiment of the bistable electromechanical actuator according to the invention in a voltage-free state at the first locked end position.
Figure 1:
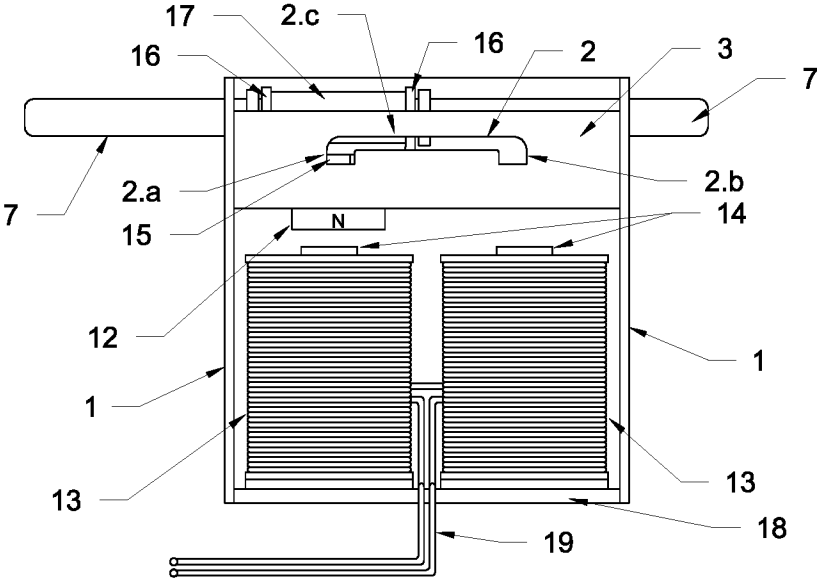
FIG. 1 is a front view of a first embodiment of the bistable electromechanical actuator according to the invention in a voltage-free state at a first locked end position.
Figure 4:
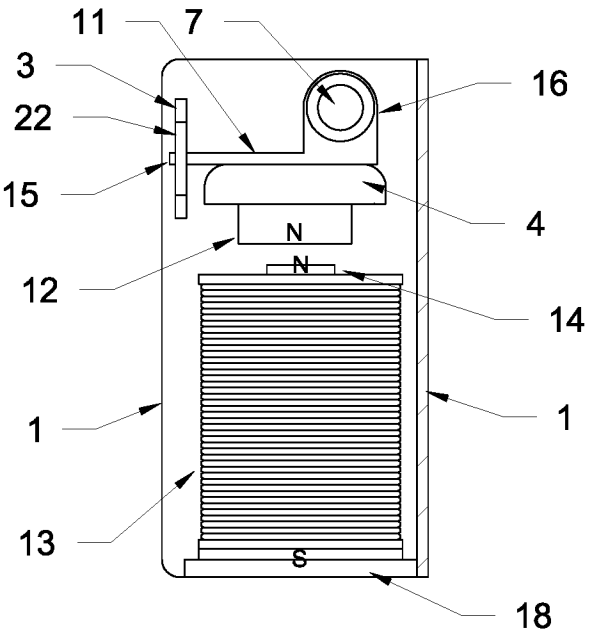
FIG. 4 is a side view of the first embodiment of the bistable electromechanical actuator according to the invention under DC voltage when being released from the first locked end position.

In FIGS. 1, 2 and 4, a first embodiment of the bistable electromechanical actuator according to the invention is illustrated in a front view, a partly sectional front view and a side view, respectively, without voltage at a first locked position. The housing 1 of the actuator comprises two guiding holes 9 formed thereon, in which an actuator shaft 7 is arranged. At least one end of the shaft 7 resides outside the housing 1 and serves as a shaft pin.

Within the housing 1 of the actuator a supporting bracket 18 is securely mounted which holds electromagnetic coils 13 connected to each other by electric wires. A base member 11 is arranged on a sleeve 17 of the shaft 7 through tabs 16, each having an opening thereon, said base member 11 being rotatable or stationary with respect to the shaft 7. A stud 15 protrudes from the base member 11 in a direction perpendicular to the longitudinal direction of the shaft 7. This stud 15 stably fits into one of the locking notches 2*a*, 2*b* of a guiding slot 2 formed in a plane extending in parallel to the shaft 7. A permanent magnet 12 is secured to the base member 11 so that the magnetic axis of said permanent magnet is orthogonal or approximately orthogonal to the longitudinal direction of the shaft 7, i.e. to the direction of displacement of the shaft 7. In the idle state of the actuator, one of the poles of the permanent magnet 12 faces the magnetic core 14 of one of the coils 13, and at the locked end positions said permanent magnet resides in the proximity of an inner end of one of the magnetic cores 14. In the drawings the magnetic poles are indicated by the abbreviations N (North) and S (South). Since for the actuator according to the invention, the position of the permanent magnets 12 relative to the coils 13 has the only restriction that one end of the coils 13 should be closer to the permanent magnets 12 then the other end thereof, the orientation of the permanent magnets 12 and the orientation of the coils 13 may be changed within a rather wide range under the above mentioned condition, but in view of a practical application (in particular, for the sake of a compact design and a higher stability) it is preferred that the magnetic axis of the permanent magnets 12 and the longitudinal axis of the coils 13 are perpendicular or approximately perpendicular to the longitudinal direction of the shaft 7.

The electromagnetic coils 13 are secured to the supporting bracket 18 by means of fastenings screws 20. The electromagnetic coils 13 have a coil body 21 and are electrically connected to each other through electric wires 19. The permanent magnet 12 is arranged within an insulation casing 4.

Figure 3:
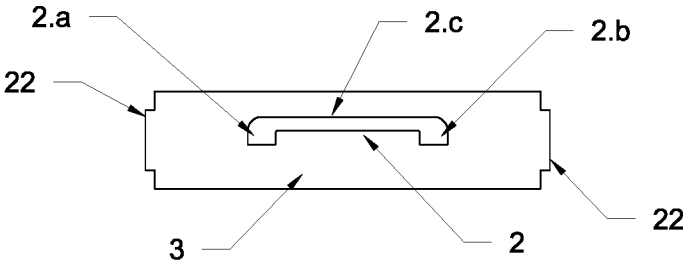
FIG. 3 is a front view of a preferred embodiment of the base member of the bistable electromechanical actuator according to the invention.

FIG. 3 illustrates the guiding element 3 in a front view, wherein the guiding slot 2, which is formed on the guiding element 3, has two locking notches 2*a*, 2*b* and a straight-line guiding section 2*c*. The guiding element 3 can be fixed to the housing 1 by means of tabs 22. It is noted that although in the drawings the guiding section 2*c* formed between the locking notches 2*a* and 2*b* is always shown as a straight guiding section, it is not necessarily straight but it may be even slightly arcuate, which would not influence the operation of the actuator according to the invention in any way.

Figure 5:
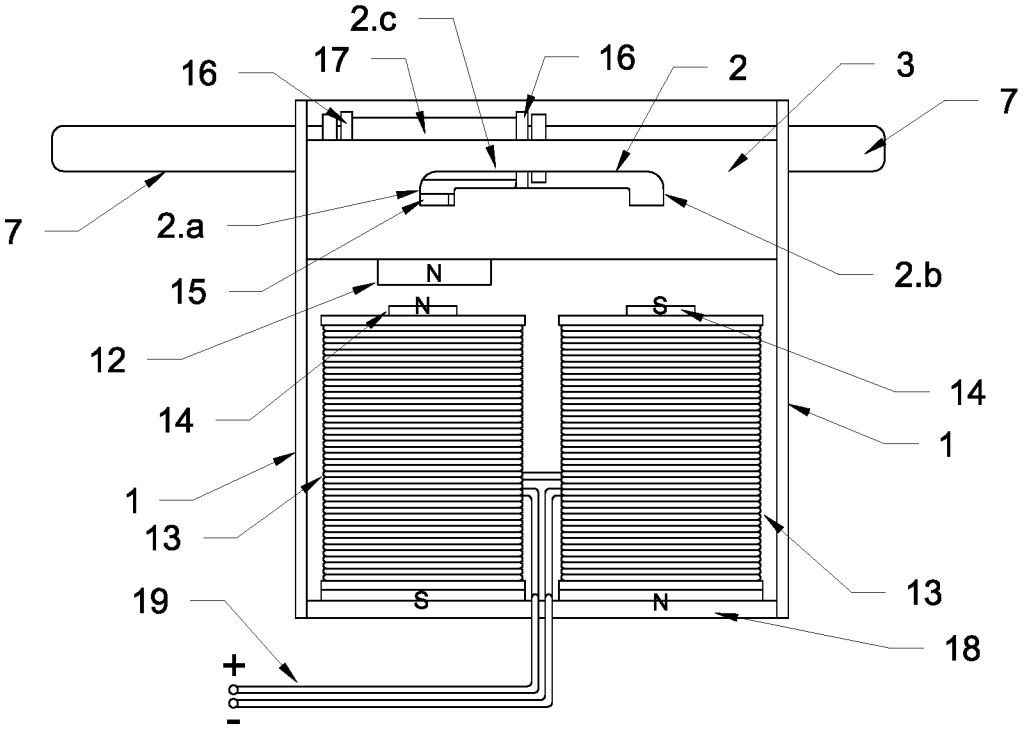
FIG. 5 is a front view of the first embodiment of the bistable electromechanical actuator according to the invention under DC voltage when being released from the first locked end position.
Figure 7:
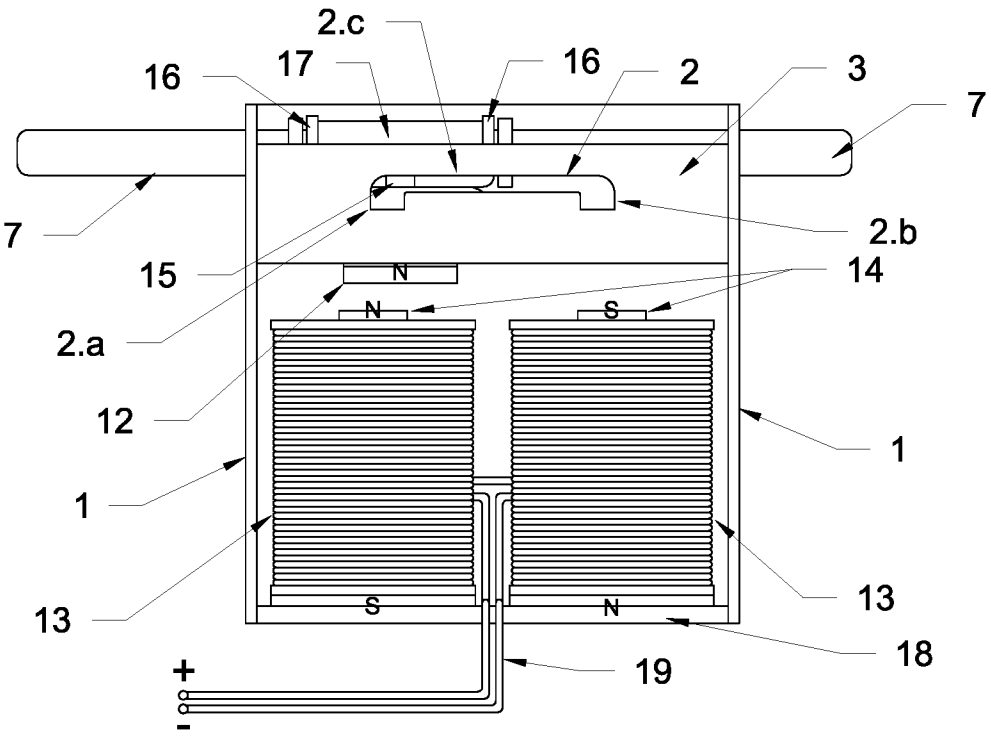
FIG. 7 is a front view of the first embodiment of the bistable electromechanical actuator according to the invention under DC voltage in an unlocked state after its release from the first end position.
Figure 6:
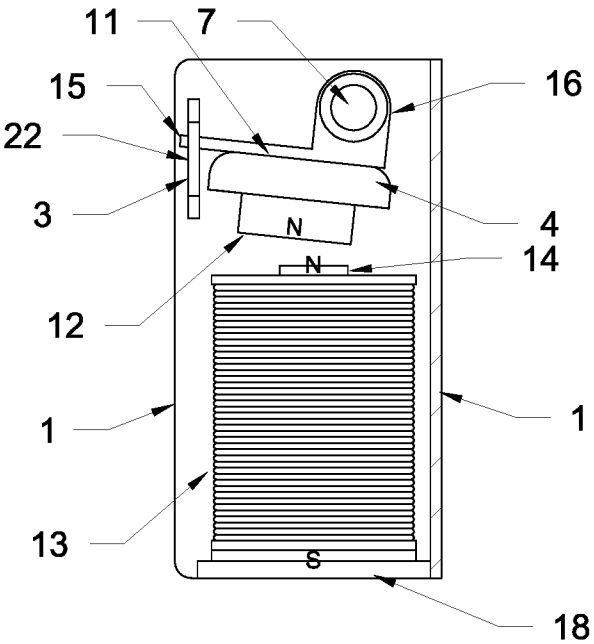
FIG. 6 is a side view of the first embodiment of the bistable electromechanical actuator according to the invention under DC voltage in an unlocked state after its release from the first end position.

FIGS. 5, 6 and 7 illustrate a first embodiment of the bistable electromechanical actuator according to the invention in a side view and front views under DC voltage in a state when the actuator is being released from one of its locked end positions. Upon the application of an operating DC voltage to the coils 13 (FIG. 5), the inner end of the coil 13 which is proximate to the permanent magnet 12 takes the same magnetic polarity as the adjacent pole of the permanent magnet and therefore it starts repelling the permanent magnet 12 mounted on the base member 11. Due to the repulsion the permanent magnet 12 starts moving away from the proximate coil 13 and thereby the stud of the base member 11 exits from the locking notch 2*a* of the guiding slot 2 of the guiding element 3 (FIGS. 6, 7). Since in the idle state the permanent magnet 12 is slightly offset, towards the distant coil 13, along the longitudinal direction of the shaft 7 with respect to the proximate end of the adjacent coil 13, after the release action the permanent magnet 12 is further repelled by the proximate coil 13 while the distant coil 13, which has an opposite polarity, is attracting it and therefore the permanent magnet 12 is forced to move towards the distant coil 13.

Figure 9:
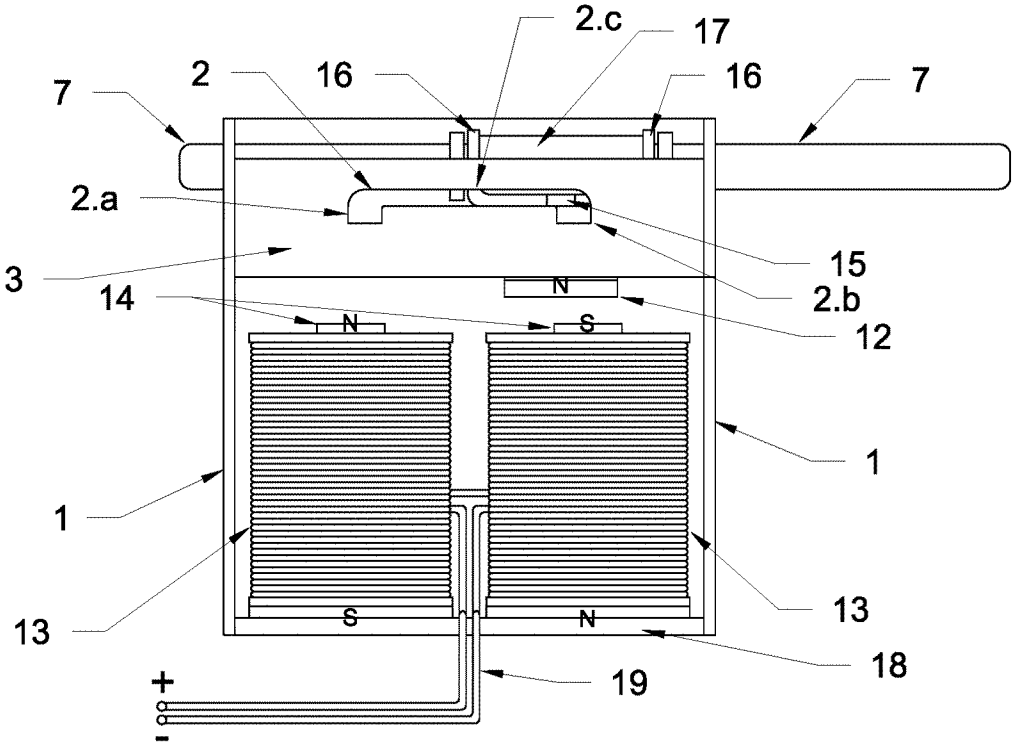
FIG. 9 is a front view of the first embodiment of the bistable electromechanical actuator according to the invention under DC voltage in a transient state.
Figure 8:
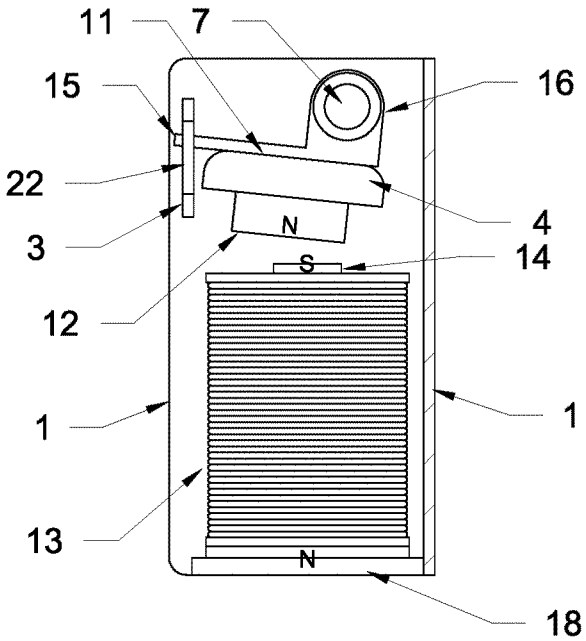
FIG. 8 is a side view of the first embodiment of the bistable electromechanical actuator according to the invention under DC voltage in a transient state.

FIGS. 8 and 9 illustrate the first embodiment of the bistable electromechanical actuator in a side view and a front view, respectively, under DC voltage in a transient state with the base member being between the two locking positions. Since the stud 15 of the base member 11 is guided along the straight (or slightly arcuate) guiding section 2*c* of the guiding slot 2 of the guiding element 3, the shaft 7 attached to the base member 11 also moves in parallel to the guiding section 2*c*. As a result, the shaft 7 can displace to a substantial extent along its longitudinal direction with respect to the housing 1 of the actuator.

Figure 11:
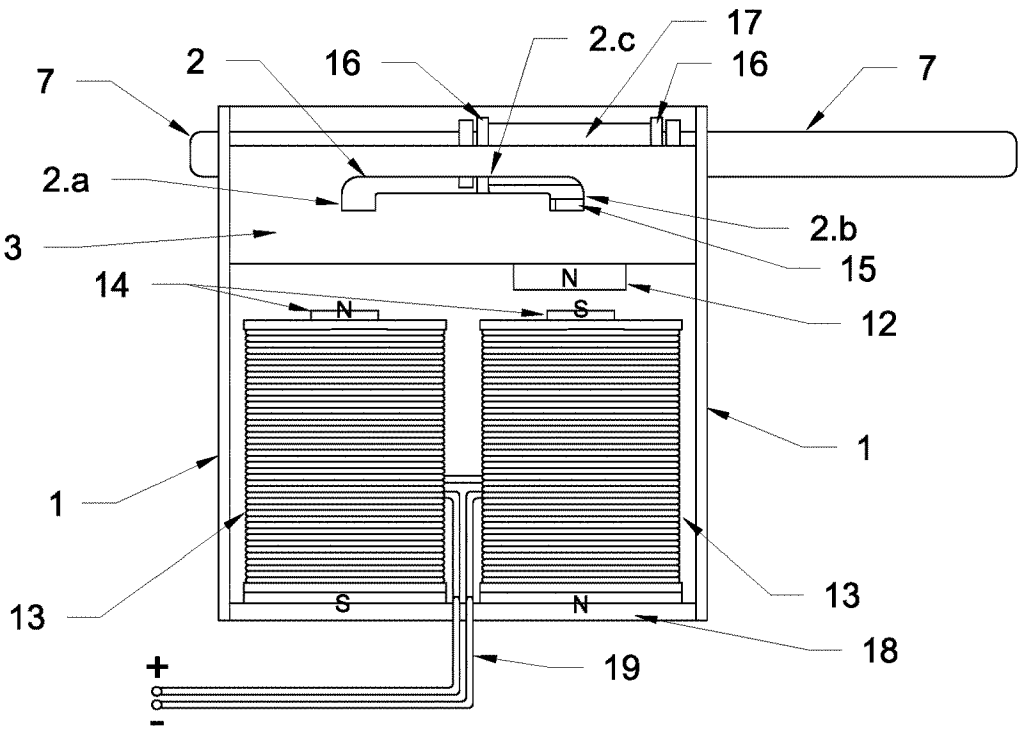
FIG. 11 is a front view of the first embodiment of the bistable electromechanical actuator according to the invention under DC voltage at the second locked end position.
Figure 10:
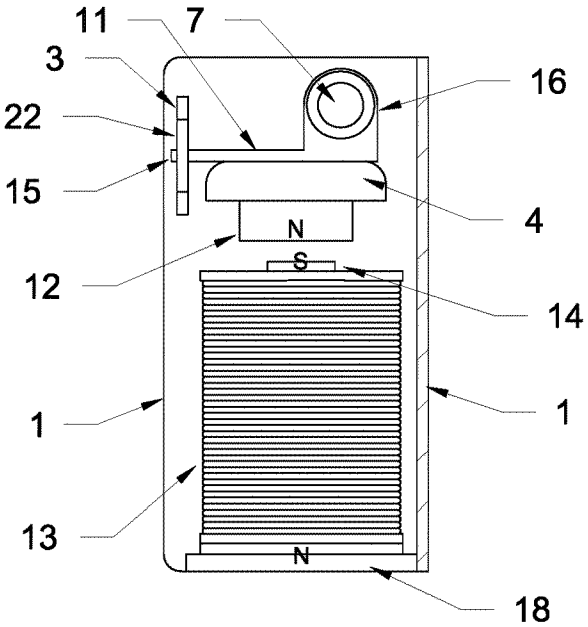
FIG. 10 is a side view of the first embodiment of the bistable electromechanical actuator according to the invention under DC voltage at a second locked end position.

FIGS. 10 and 11 show the first embodiment of the bistable electromechanical actuator according to the invention in a partly sectional front view and a side view, respectively, under DC voltage at the other locked end position. In this case, due to the attractive force of the coil 13 adjacent to the other end position, both of the base member 11 and the permanent magnet 12 mounted thereon start moving towards the adjacent coil 13, and finally the stud 15 of the base member 11 gets seated in the locking notch 2*b* of the guiding slot 2.

Figure 13:
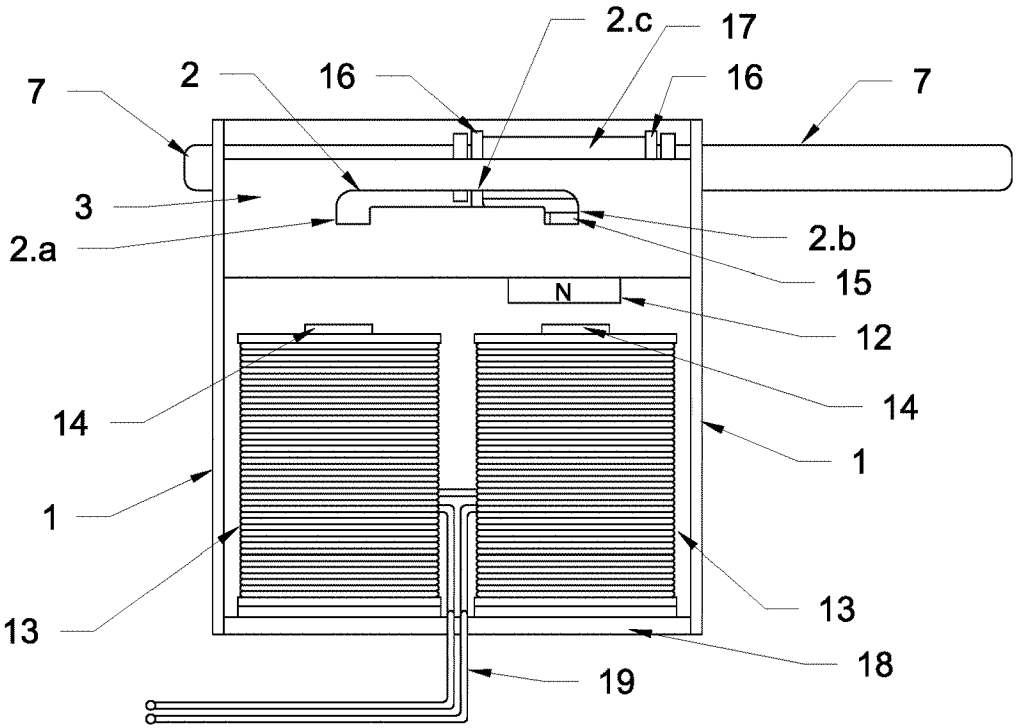
FIG. 13 is a front view of the first embodiment of the bistable electromechanical actuator according to the invention without voltage at the second locked end position.
Figure 12:
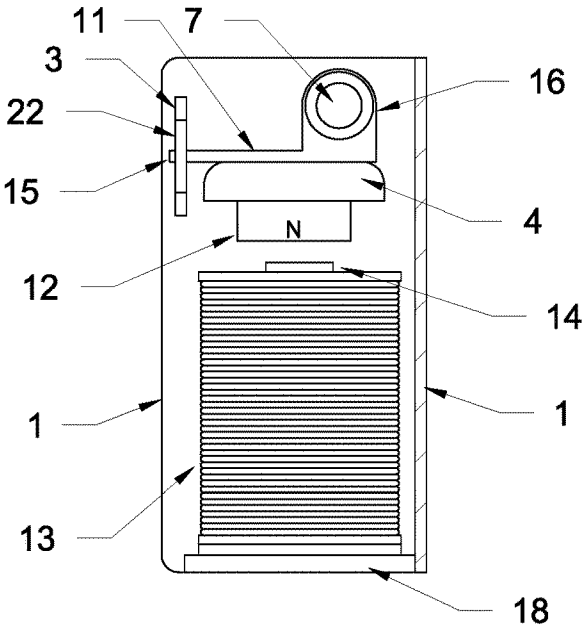
FIG. 12 is a side view of the first embodiment of the bistable electromechanical actuator according to the invention without voltage at the second locked end position.

FIGS. 12 and 13 show the first embodiment of the electromechanical actuator according to the invention in a side view and a front view, respectively, in a voltage-free condition at the other locked end position. Since no voltage is applied to the coils 13, the permanent magnet 12 magnetizes the magnetic core 14 of the adjacent coil 13, thereby a strong magnetic attractive force is acting therebetween, which stably holds the base member 11 at the locked position and thereby secures the shaft 7 connected to the base member 11.

It is noted that the permanent magnet 12 and the magnetic core 14, as well as the idle distance therebetween are dimensioned so that at both locked end positions there is a substantially large magnetic attractive force between the permanent magnet 12 and the magnetic core 14 for preventing any unintentional release of the base member 11.

In the first embodiment of the electromechanical actuator according to the invention, the base member 11 can turn around the shaft 7 at the tabs 16. Hence, when being released from the first end position and when getting locked at the second end position, the shaft 7 itself does not turn away.

In the case where the base member 11 is rigidly fixed to the shaft 7 by means of the tabs 16, at releasing (when the base member and the permanent magnet 12 mounted thereon slightly rise together due to the repulsive effect of the adjacent coil 13), the shaft 7 also slightly turns around its own axis and then it moves along its longitudinal direction in this slightly turned state until the base member 11 gets locked at the other end position of the guiding element 3. When getting locked, the base member 11 snaps into its end position and the stud 15 formed thereon gets seated in the corresponding locking notch of the guiding slot 2, while the shaft 7 turns back into its idle angular position.

Figure 14:
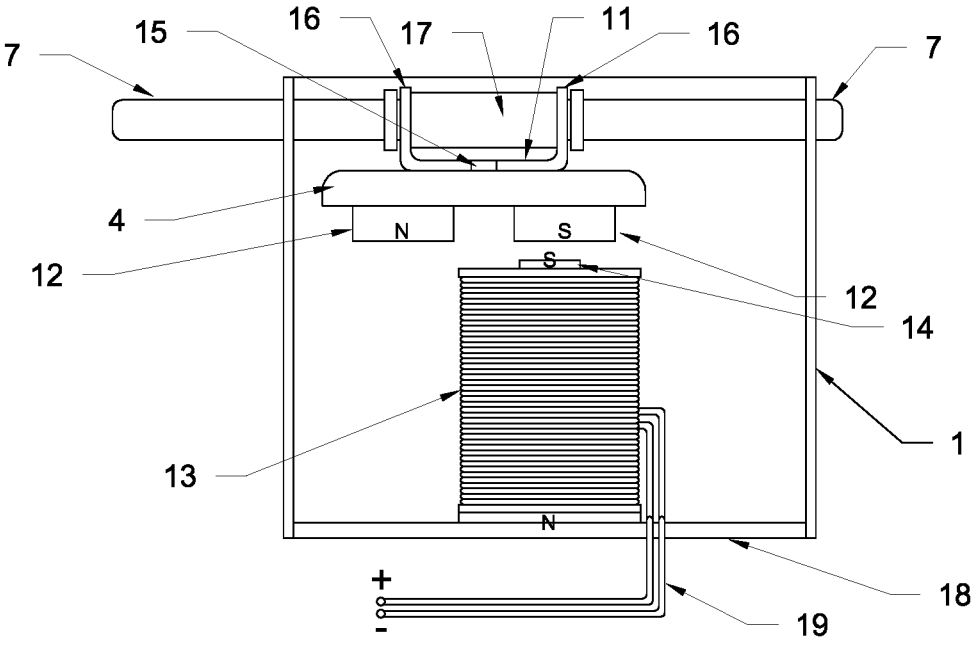
FIG. 14 is a front view of the second embodiment of the bistable electromechanical actuator according to the invention under DC voltage when being released from a first locked end position, wherein the actuator comprises two permanent magnets and one electromagnetic coil.

FIG. 14 illustrates a second embodiment of the bistable electromechanical actuator according to the present invention in a front view under DC voltage at a first locked end position. (In this figure, the guiding element 3 is not shown for the sake of simplicity.) This embodiment differs from the first embodiment shown in FIGS. 1 to 13 in that it comprises two permanent magnets mounted on the base member 11 with opposite polarities, said permanent magnets 12 arranged adjacent to each other along the longitudinal direction of the shaft 7, whereas a single coil 13 is mounted within the housing 1. The coil 13 is positioned so that at any of the locked end positions of the base member 11 the permanent magnet 12 is slightly offset, along the longitudinal direction of the shaft 7 towards outside of the housing 1, with respect to the proximate end of the coil 13. In the idle state the permanent magnet 12 adjacent to the coil 13 is slightly offset outwards (i.e. towards the side wall of the housing 1) with respect to the proximate end of the coil 13, thereby at release the coil 13 exerts a repulsive magnetic force to the permanent magnet 12 of the base member 11, and thereby causes the base member to move away from the coil 13 while simultaneously attracting the other (distant) permanent magnet 12. This results in a longitudinal displacement of the shaft 7 by means of the guiding element 3.

Figure 15:
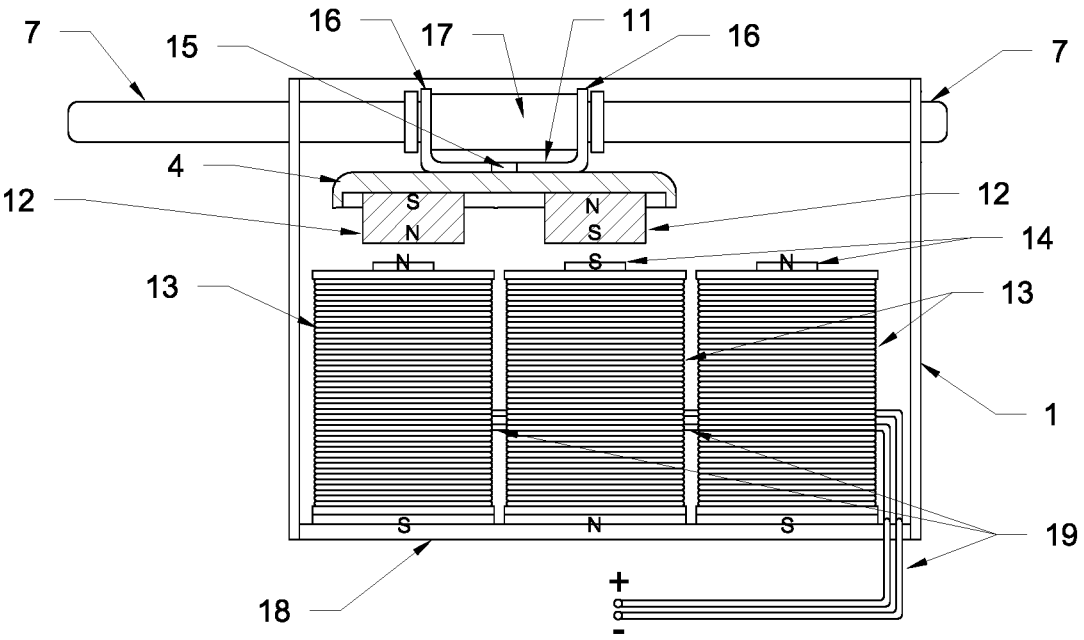
FIG. 15 is a partly sectional front view of a third embodiment of the bistable electromechanical actuator according to the invention under DC voltage when being released from a first locked end position, wherein the actuator comprises two permanent magnets and three electromagnetic coils.

FIG. 15 illustrates a third embodiment of the bistable electromechanical actuator according to the invention in a partly sectional front view under DC voltage at a first locked end position. (In this figure the guiding element 3 is not shown for the sake of simplicity.) This embodiment differs from the first embodiment shown in FIGS. 1 to 13 in that there are two permanent magnets 12 mounted with opposite polarities on the base member 11 at a predetermined distance from each other along the longitudinal direction of the shaft 7 (as well as in the second embodiment shown in FIG. 14), whereas three coils 13 are arranged within the housing 1, said coils 13 being arranged side by side in a direction parallel to the shaft 7. The coils 13 are positioned so that at either locked end position of the base member 11, the outer permanent magnet 12 is slightly offset inwards with respect to the inner end of the proximate one of the outer coils 13. In the idle state the magnetic axis of the permanent magnet 12 adjacent to the respective outer coil 13 is slightly offset inwards (i.e. towards the center coil 13), thereby at release said outer coil 13 exerts a repulsive magnetic force to the proximate permanent magnet 12 of the base member 11, and thereby causes that permanent magnet 12 to move away from said outer coil 13. At the same time the other permanent magnet is repelled by the center coil 13, while the other one of the outer coils 13 is attracting it, as a result of which the base member 11 exits from its locked position and due to the guiding slot 2 of the guiding element 3, the base member 11 starts moving towards its other end position along the longitudinal direction of the shaft 7. At the other end position the base member 11 gets locked according to the aforementioned mechanism.

Figure 16:
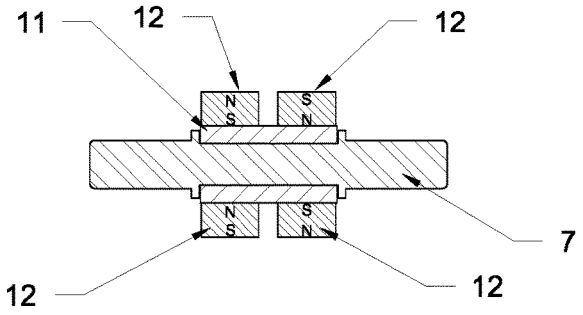
FIG. 16 is a front view of a base member in a fourth embodiment of the bistable electromechanical actuator according to the invention, wherein the base member is provided with four permanent magnets.
Figure 17:
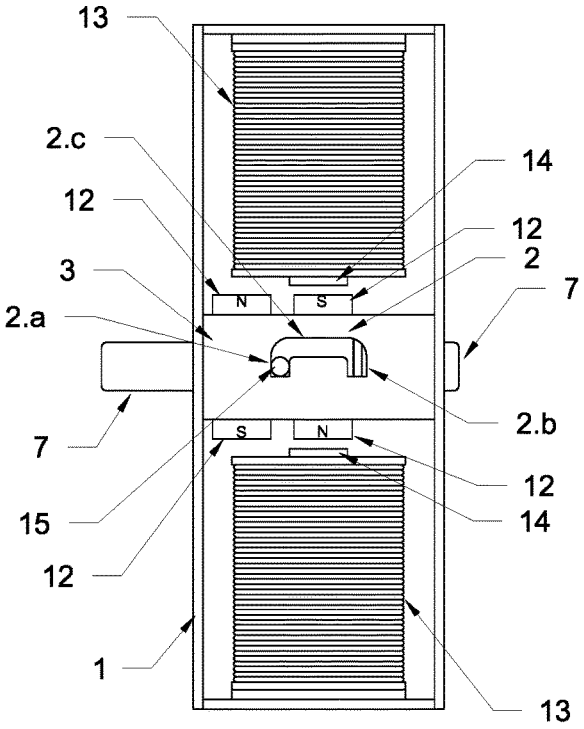
FIGS. 17 and 18 are front views of the forth embodiment of the bistable electromechanical actuator according to the invention at its first and second locked end positions, respectively.
Figure 18:
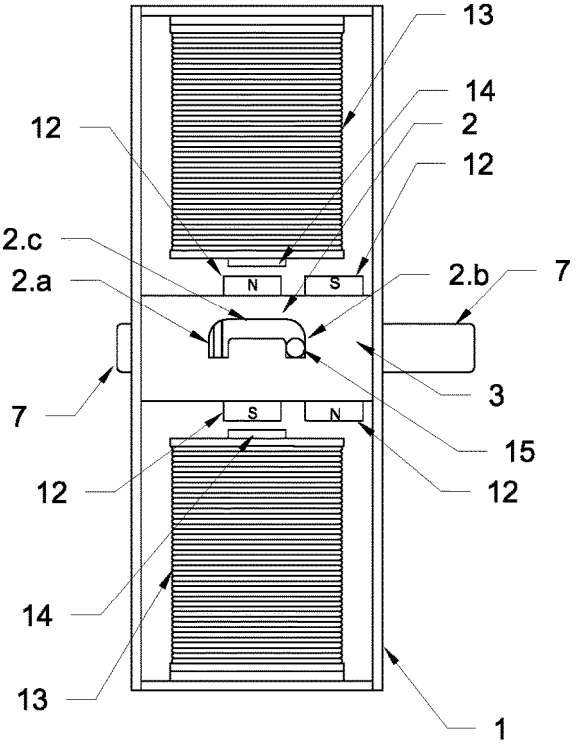

FIG. 16 illustrates a base member with four permanent magnets in a front view of a fourth embodiment of the bistable electromechanical actuator according to the invention, and FIGS. 17 and 18 illustrate the entire actuator of this embodiment in a front view in its first and second locked end positions, respectively. In this embodiment, to achieve bigger forces and thereby an even faster operation, on each one of the opposite sides of the base member 11 two permanent magnets 12 are arranged with opposite polarities pair by pair. In front of each pair of permanent magnets 12 a respective coil 13 is arranged in the same way as in the second embodiment shown in FIG. 14, i.e. the two coils 13 are arranged opposite to each other so that one of the pairs of the permanent magnets 12 is slightly offset along the longitudinal direction of the shaft 7, with respect to the inner end of the adjacent coil 13. The processes of release and locking are the same as in the second embodiment shown in FIG. 14 with the only difference that the base member 11 with the permanent magnets 12 and the shaft 7 are moved by two coils 13 simultaneously acting on the opposite sides of the base member 11.

Figure 21:
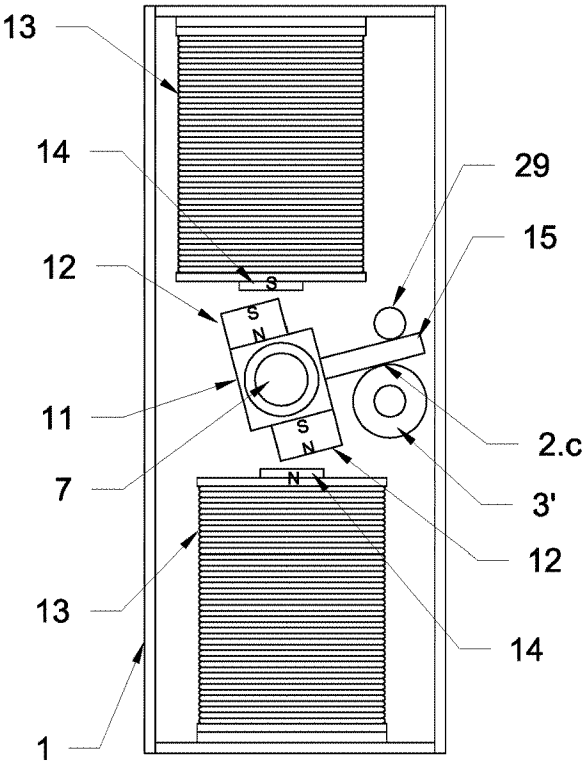
FIG. 21 is a side view of the fifth embodiment of the bistable electromechanical actuator according to the invention under DC voltage in a transient state.
Figure 20:
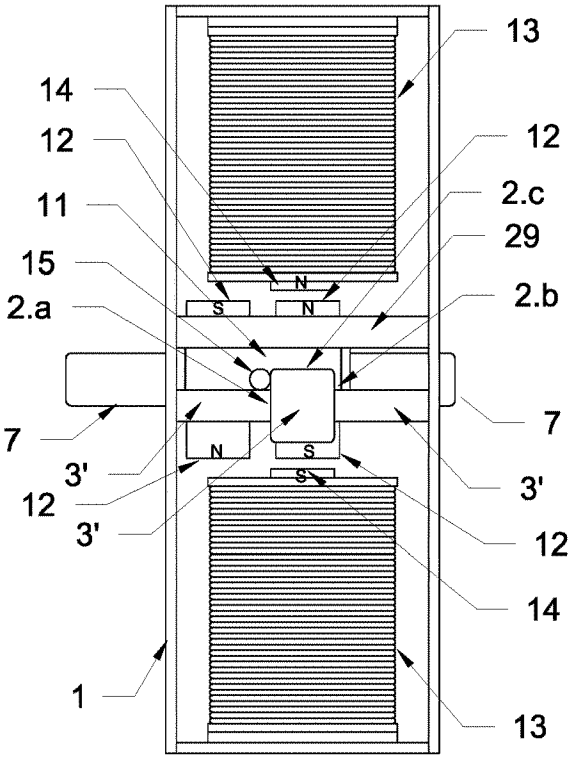
FIGS. 19 and 20 are a side view and a front view of a fifth embodiment of the bistable electromechanical actuator according to the invention, respectively, under DC voltage at a first locked end position.
Figure 19:
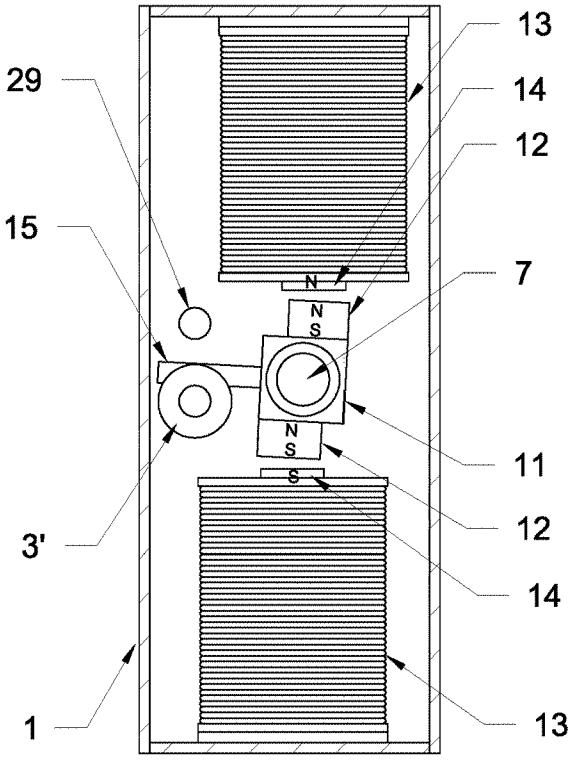

FIGS. 19 and 20 illustrate a fifth embodiment of the bistable electromechanical actuator according to the invention in a side view and a front view, respectively, under DV voltage at a first locked end position, and FIG. 21 illustrates the same embodiment in a side view, under DC voltage in a transient state between the two end positions. In this embodiment the configuration of the base member 11 mounted on the shaft 7 is the same as that of the base member used in the previous embodiments, but the guiding element 3' is not in the form of a plate with a guiding slot, but it is formed as a guiding shaft extending in parallel to the shaft 7 and fixed to the housing 1. Between the locking positions of the guiding element 3' the shaft is slightly thickened and the envelope surface of this section of enlarged diameter defines the guiding section 2*c*, which is preferably straight (i.e. parallel to the longitudinal direction of the guiding element 3'), but optionally (not shown in the drawings) said envelop surface defining the guiding section may also be somewhat arcuate along the longitudinal direction of the guiding shaft 3'. As shown in FIGS. 19 and 20, in the locked state the stud 15 of the base member 11 fits into a notch at one end of the thickened section of the guiding element 3' and it is stably locked there also in a voltage-free state due to the magnetic attractive interaction between the permanent magnets 12 and the magnetic core 14 of the coils 13. At release the base member 11 slightly turns and moves away from the guiding element 3' due to the magnetic fields resulted from the DC voltage applied to the coils 13 with appropriate polarities, while the coils 13 force the permanent magnets 12 to move towards the other end position. As a result the stud 15 of the base member 11 slides along the thickened straight guiding section 2*c* of the guiding element 3' (this situation can be seen in FIG. 21), and then when reaching the end of the thickened section, it snaps into the locking notch at the beginning of the thinner shaft section due to the magnetic forces while the base member 11 turns back towards the guiding element 3'. It is noted that in this case the base member 11 can be attached to the shaft 7 in two ways, i.e. either pivotably or fixedly. In the former case the shaft 7 does not turn away during its displacement, whereas in the latter case the shaft 7 slightly turns away together with the base member 11 at release and then it returns to its idle angular position by turning in the opposite direction when getting locked in the other end position To prevent the permanent magnet 12 from moving away from the guiding shaft defining the guiding element 3' at a release action, a counter-supporting shaft 29 is secured to the housing 1. In the transient state between the end positions, the stud 15 of the base member slides along between the thickened section of the guiding element 3' and the counter-supporting shaft 29 from one locking notch to the other one.

Figure 23:
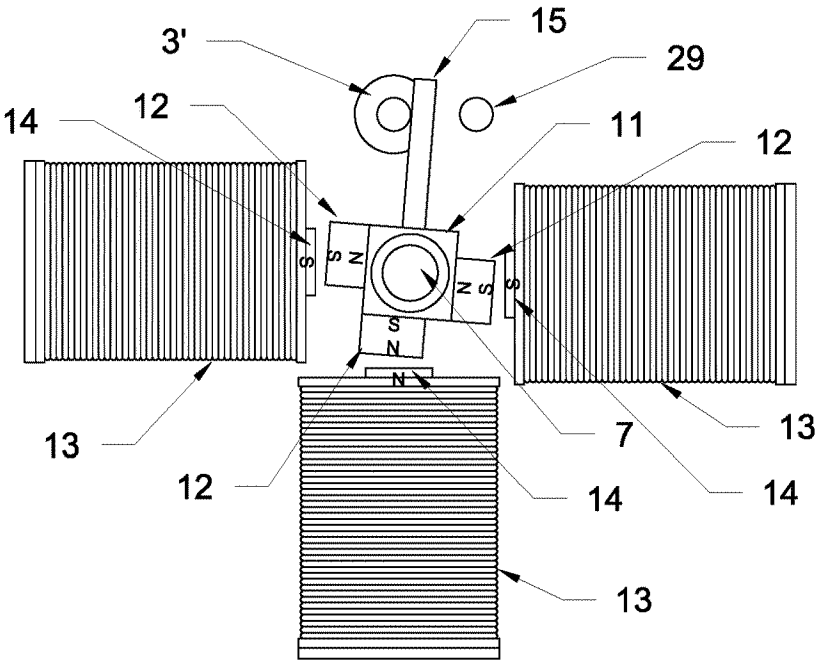
FIG. 23 is a side view of a seventh embodiment of the bistable electromechanical actuator according to the invention under DC voltage, wherein the actuator comprises three pairs of permanent magnets arranged at an angular distance of 90° from each other, and three electromagnetic coils arranged opposite thereto.
Figure 22:
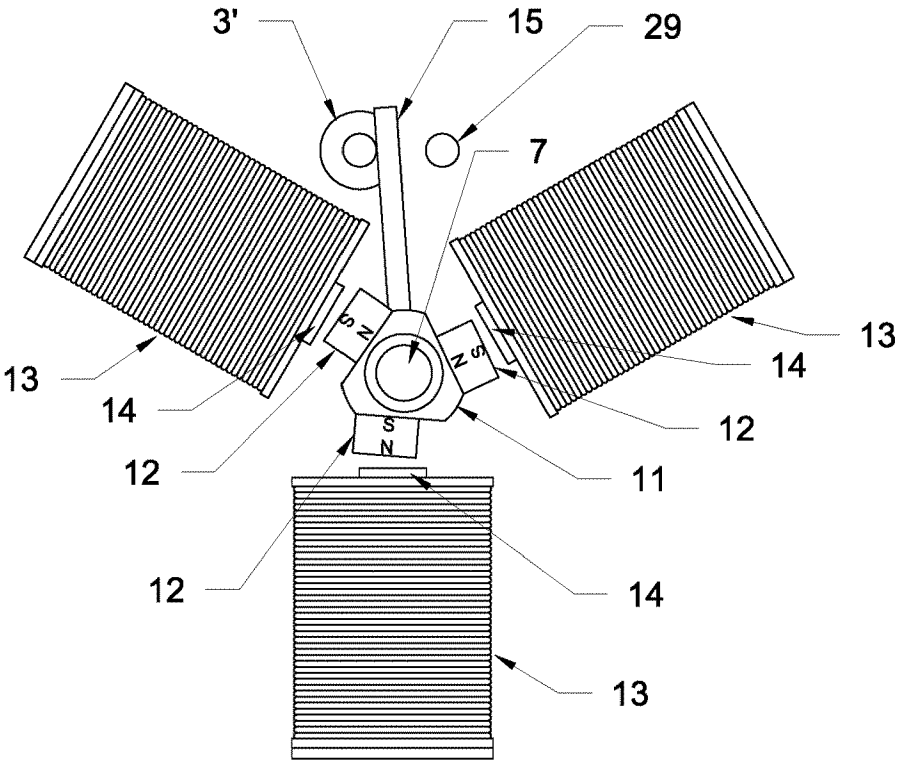
FIG. 22 is a side view of a sixth embodiment of the bistable electromechanical actuator according to the invention without voltage, wherein the actuator comprises three pairs of permanent magnets arranged at an angular distance of 120° from each other, and three electromagnetic coils arranged opposite thereto.

FIG. 22 illustrates a sixth embodiment of the bistable electromechanical actuator according to the invention in a side view, in a voltage-free state, wherein the principle of operation is the same as in the fifth embodiment shown in FIGS. 19, 20 and 21, with the only difference that in this embodiment the actuator comprises three pairs of permanent magnets 12 arranged at a relative angular position of 120° and three electromagnetic coils 13 arranged in front of said pairs of permanent magnets. FIG. 23 illustrates a seventh embodiment of the bistable electromechanical actuator according to the invention in a side view, under DC voltage, wherein the principle of operation is the same as in the fifth embodiment shown in FIGS. 19, 20 and 21, with the only difference that in this embodiment the actuator comprises three pairs of permanent magnets 12 arranged at relative angular positions of 90°/180° and three electromagnetic coils 13 arranged in front of said pairs of permanent magnets. These two latter embodiments differ from the previous ones in that instead of two coils, now three coils 13 move the base member 11 with the permanent magnets 12, which provides an even faster and more stable locking operation. Although in FIGS. 22, 23 the electromagnetic coils 13 are shown in the arrangements with relative angular positions of 120° and 90°/180°, respectively, it is obvious for a skilled person that the relative angular position of the electromagnetic coils 13 may also be defined in a different way, and even more than three coils may be used to carry out the invention on the basis of the same principle of operation.

Figure 25:
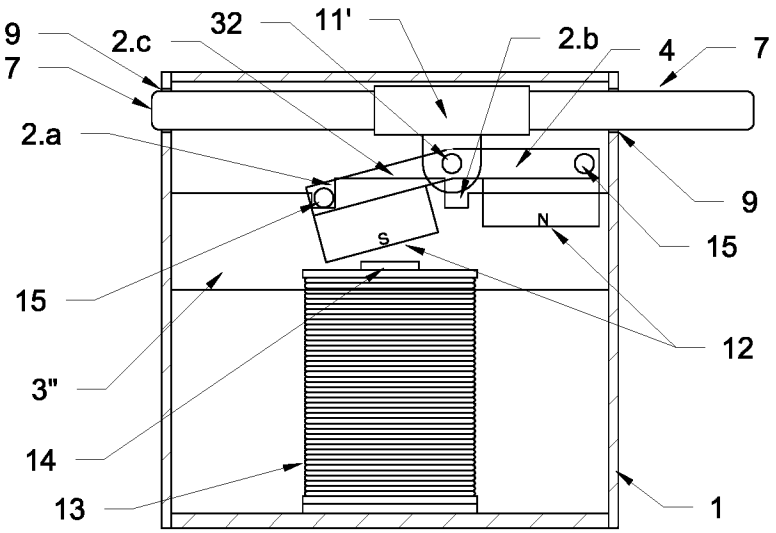
FIGS. 24 to 26 are front views of an eighth embodiment of the bistable electromechanical actuator according to the invention at a first and a second locked end position.
Figure 24:
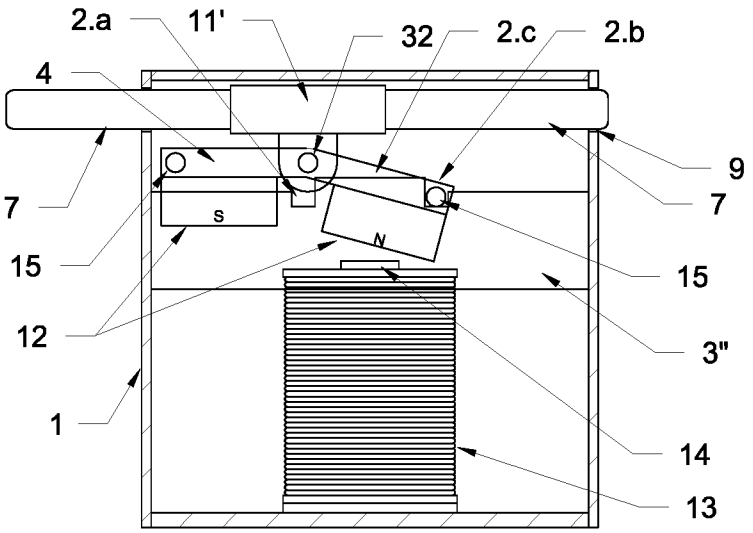
Figure 26:
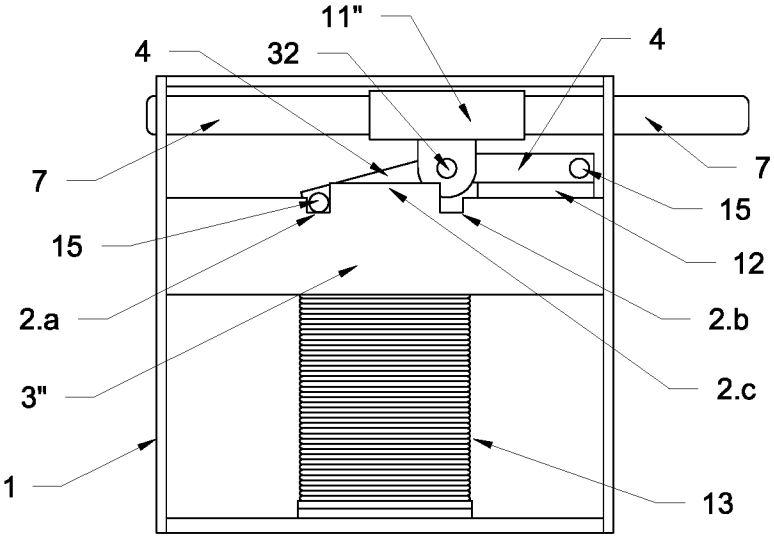

FIGS. 24, 25 and 26 illustrate and eighth embodiment of the bistable electromechanical actuator according to the invention in a side view at first and second locked end positions. In this embodiment the base member 11 has two permanent magnets 12 which are fixed to the base member 11 with opposite polarities so that their magnetic axes define an acute angle, preferably an angle of about 15-20°. The base member 11 is connected to the shaft 7 through a hinge 32 in a way that the rotational axis of the hinge 32 is perpendicular to the actuator shaft 7. In this case the base member 11 has two studs 15, one being adjacent to each permanent magnet 12, and said studs 15 are arranged so that the centers of rotation of the two studs 15 and the center of rotation of the hinge 32 of the base member 11 do not reside on a single straight line. In either end position the respective stud 15 of the base member 11 fits into a respective one of the locking notches 2*a*, 2*b* of the guiding element 3" and it is stably locked therein. Upon the application of voltage to the coil 13, after release the permanent magnet 12 adjacent to the unlocking stud 15 exits from the locking notch 2*a* or 2*b* and due to the magnetic forces it starts moving along the straight guiding section 2*c* of the guiding element 3" while the actuator shaft 7 is moving together with it. When the other stud belonging to the other permanent magnet 12 reaches the other locking notch 2*a* or 2*b*, it snaps into the locking notch and gets locked therein stably due to the magnetic forces. After deactivating the coils 13 the base member 11 still remains in a locked state due to the magnetic field looping through the magnetic core 11 of the coil 13. It is noted that this embodiment, similarly to the third embodiment shown in FIG. 15, operates even more efficiently when it comprises three electromagnetic coils arranged side by side. It is also noted that the guiding section 2*c* of the guiding element 3" may be slightly arcuate in the plane of the sheet-like guiding element 3" also in this case.

In the above various embodiments of the bistable electromechanical actuator according to the invention have been described with reference to the drawings, wherein one or more electromagnetic coils are secured to a supporting bracket, the base member attached to the actuator shaft carries one or more permanent magnets and wherein the base member has two locked end positions and a straight working path in parallel to the actuator shaft.

The particular embodiments described above serve only as examples and it is obvious for a person skilled in the art how the illustrated embodiments may be modified or combined with each other to carry out further embodiments within the scope of the invention.

The advantages of the solution according to the present invention include the relatively long and straight working path and the two locked end positions even under a voltage-free condition of the actuator, which features are all resulted from the principle of operation of the invention and its structural design. Consequently, it can operate locking assemblies and mechanical units for which two locked end positions and a substantially long and straight working path are required. In these devices the invention can be applied instead of the conventional, electrically driven actuators that comprise a screw drive transmission. The principle of operation and the structural design are simple and efficient as the actuator comprises only few rotating and moving parts, thereby making the projection of some industrial applications easier, further provides an optimal and stable operation, as well as high reliability and a cost-effective production.

The invention claimed is:

1. A bistable electromechanical actuator, comprising an actuator shaft (7) arranged in a housing (1), said shaft being movable along its longitudinal direction, a base member (11) attached to the actuator shaft (7), said base member being slidably attached to a guiding element (3, 3',3") through a stud (15), said guiding element being secured to the housing and having two locking notches (2*a*, 2*b*) with a predetermined distance therebetween and further having a straight or substantially straight guiding section (2*c*) formed between said two locking notches in a plane parallel to the longitudinal direction of said shaft (7), wherein at least one permanent magnet is fixed to the base member (11) so that the magnetic axis of the at least one permanent magnet is perpendicular or substantially perpendicular to the longitudinal direction of said shaft (7), and wherein at least one electromagnetic coil (13) is arranged within said housing (1) so that in an idle state of the actuator, one end of the at least one coil (13) is arranged to be adjacent to the at least one permanent magnet (12) in such a manner that the position of said end of the respective coil (13) is slightly offset, along the longitudinal direction of said shaft (7), with respect to the position of the permanent magnet (12) adjacent thereto.

2. The actuator according to claim 1, wherein the base member (11) is pivotably connected to the actuator shaft (7).

3. The actuator according to claim 1, wherein the base member (11) is rigidly fixed to the actuator shaft (7).

4. The actuator according to claim 1, wherein the guiding element (3) is formed as a plate extending in parallel to the actuator shaft (7), wherein the guiding section (2*c*) is formed in said plate as a straight or slightly arcuate slot.

5. The actuator according to claim 1, wherein the guiding element (3') is formed as a shaft extending in parallel to the actuator shaft (7) and having a section of enlarged diameter, the envelop surface of said thickened section defining a straight or slightly arcuate guiding section (2*c*).

6. The actuator according to claim 1, wherein the at least one permanent magnet is a single permanent magnet (12), and the at least one electromagnetic coil is two electromagnetic coils (13) mounted within the housing (1), adjacent to each other along the longitudinal direction of said shaft (7), said two coils being configured to produce opposite magnetic polarities at their ends proximate to the base member (11) when an operating voltage is applied thereon.

7. The actuator according to claim 1, wherein the at least one permanent magnet is two permanent magnets (12) adjacent to each other along the longitudinal direction of said shaft (7), one of the two magnets having a magnetic polarity opposite to that of the other of the two magnets, and wherein the at least one electromagnetic coil is a single electromagnetic coil (13) mounted within the housing (1).

8. The actuator according to claim 1, wherein at least one permanent magnet is three permanent magnets (12) arranged at predetermined angular positions around said shaft (7), and wherein the at least one electromagnetic coil is three electromagnetic coils (13) mounted within the housing (1) so that in an idle state of the actuator, one end of each of the three coils (13) is arranged to be adjacent to a respective one of said three permanent magnets (12).

9. The actuator according to claim 8, wherein the permanent magnets (12) are arranged at an angular distance of 90°/180° or equally 120° relative to each other.

10. The actuator according to claim 1, wherein said shaft has an actuator pin outside the housing (1), wherein the base member (11) is hingedly attached to the actuator shaft (7), wherein said base member is slidably attached to the guiding element (3, 3',3") through two studs (15), wherein the at least one permanent magnet is two permanent magnets fixed to the base member (11), close to said studs (15), so that the magnetic axes of the permanent magnets define an acute angle, wherein the at least one electromagnetic coil (13) is arranged within said housing (1) so that in an idle state of the actuator, one end of the at least one coil (13) is arranged to be adjacent to one of the two permanent magnets (12) in such a manner that the position of said end of the respective coil (13) is slightly offset, along the longitudinal direction of said shaft (7), with respect to the position of the permanent magnet (12) adjacent thereto, and wherein the centers of rotation of the two studs (15) and the center of rotation of the hinge (32) of the base member (11) do not reside on a single straight line.

* * * * *